United States Patent [19]

Boettcher

[11] 4,385,713

[45] May 31, 1983

[54] HELICAL VENDING MACHINE WITH PIVOT ROD ADJUSTMENT

[75] Inventor: William C. Boettcher, Foley, Mo.

[73] Assignee: D.O.V.E. Equipment Corporation, Winfield, Mo.

[21] Appl. No.: 248,558

[22] Filed: Mar. 27, 1981

Related U.S. Application Data

[63] Continuation-in-part of Ser. No. 35,421, May 2, 1979, Pat. No. 4,258,860, and a continuation-in-part of Ser. No. 139,991, Apr. 14, 1980, Pat. No. 4,312,460.

[51] Int. Cl.[3] ..... G07F 11/36

[52] U.S. Cl. ..... 221/75; 221/241

[58] Field of Search ..... 221/75, 241, 242; 198/778, 659, 661, 670

[56] References Cited

U.S. PATENT DOCUMENTS 4,149,653 4/1979 Lennartson ..... 221/75

*Primary Examiner*—Stanley H. Tollberg

*Attorney, Agent, or Firm*—Gravely, Lieder & Woodruff

[57] ABSTRACT

This invention involves a vending machine having helix discharge units used to store and dispense packaged objects such as ship products, etc. The unit preferably utilizes a rotatable helix dispensing spindle having an adjustable rod within the convolutions of the helix which can be pivoted from horizontal to vertical to vary the size of the merchandise storage compartments in the helix to accommodate different size packages. The size of the compartments is determined by the position of the rod, the compartment being largest when the rod is vertical and smallest when it is horizontal.

5 Claims, 4 Drawing Figures

HELICAL VENDING MACHINE WITH PIVOT ROD ADJUSTMENT

REFERENCE TO PRIOR APPLICATIONS

This application contains subject matter in common with and is a continuation-in-part of my co-pending applications Ser. No. 35,421, now U.S. Pat. No. 4,258,860 filed May 2, 1979, and Ser. No. 139,991, now U.S. Pat No. 4,312,460 filed Apr. 14, 1980.

BACKGROUND OF THE INVENTION

This invention relates generally to vending machines, and more particularly to those which utilize a helical coil to advance items from a storage position within the machine to a chute for discharge to the consumer. U.S. Pat. Nos. 3,178,055; 3,335,907; and 3,601,281 disclose various vending machines of this type. The machines usually have a discharge chute mounted on the front or at the side and are designed to hold a plurality of individual item discharge units. The units are advanced by rotation of the coil by means of a motor activated by the customer after money is deposited in the machine.

One problem in these vendors, which is addressed in Ser. No. 35,421, now U.S. Pat. No. 4,258,860 is that of providing different sized compartments in the units to accommodate different sized packages.

Economy of manufacture dictates that the individual units, and hence the trays, be of identical construction. The consumer, however, demands that a wide range of products be made available to him through vending machines. The size and shape of the packaging for these various products varies from the typical sack for potato chips and the like, to packages of various sizes of cigarettes, and to still other packages for thin or little cigars, mints, lifesavers, gum and other products.

The problem for a manufacturer, therefore, is to provide a standard-sized tray, based quite often on a size necessary for vending cigarette packages, which is readily convertible to handling the smaller mint, gum, or candy bar packages.

While there are various methods for changing the size of the compartments, these earlier devices all result in compartments of fixed size, so that if the operator of the machine wished to change the size on site he needs to disassemble part or all of the unit and possibly has to take the unit back to his base of operations. It is quite desirable that a method be provided for adjusting the size of the units at the site, so that popular items can be included in a particular machine even if they happen to differ in size from the items currently vended from the machine.

Among the patents which have attempted to utilize a spacer of some sort to reduce the size of the compartments are Whistin U.S. Pat. No. 3,908,858, and Wittern U.S. Pat. No. 3,929,255. However, neither of these units is completely adjustable on site and does not achieve all of the objects and advantages of the present invention.

Accordingly, it is a principal object of the present invention to provide a helical vending unit having an adjustable panel positioned within the helix to change the size of the merchandise compartment encompassed by the helix and a tray in which the helix runs.

These and other objects and advantages will become apparent hereinafter.

SUMMARY OF THE INVENTION

The present invention comprises a vending machine unit in which a helix turns in a tray to progress items toward the open end of the tray and a panel mounted in the helix and movable between vertical and horizontal to change the size of the merchandise compartment defined between the panel and a side wall of the tray in which the helix is positioned.

In the drawings wherein like numbers refer to like parts wherever they occur:

Figure 1:
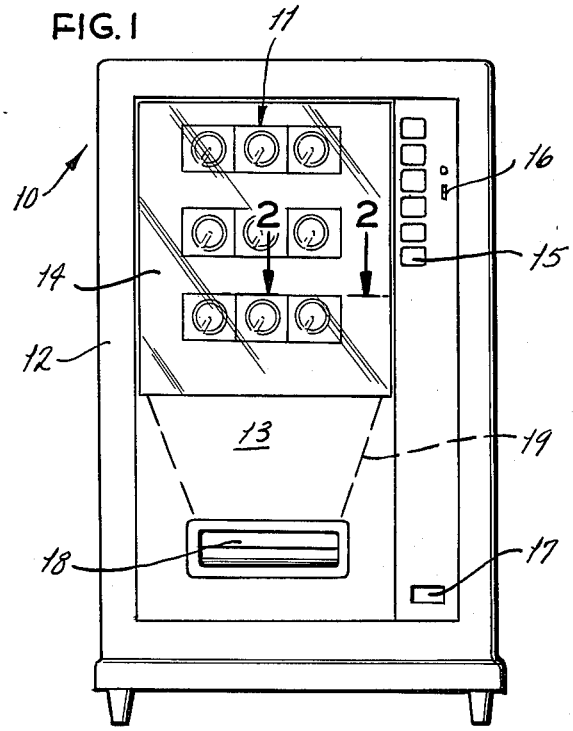
FIG. 1 is a front elevational view showing a vending machine having individual units incorporated therein.

The present invention is embodied in a vending machine 10 (FIG. 1) having a plurality of helix discharge units indicated generally by the numeral 11 which preferably are disposed in side-by-side horizontal and/or vertical relationship within the storage compartment portion of the machine 10. If desired, the units 11 can be used individually, but the more usual arrangement is a bank within a cabinet 12 as shown. The cabinet or storage compartment 12 includes a front door 13 having a clear see-through window portion 14 through which the customer may view the merchandise residing in the units 11. Mounted on the machine 10 are selection means 15 which activate the individual units 11, a coin slot 16 and a coin return 17. A discharge opening 18 positioned at the lower portion of the door 13 is connected to a discharge chute 19 which connects with the open front end of the vend units 11.

Figure 2:
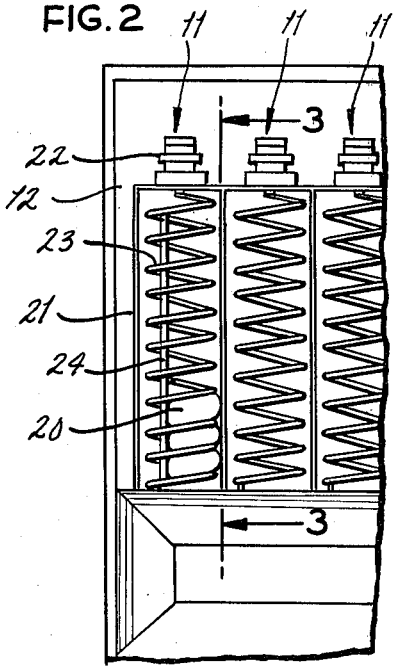
FIG. 2 is a sectional view taken along line 2—2 of FIG. 1 showing several of the individual vend units in plan.
Figure 3:
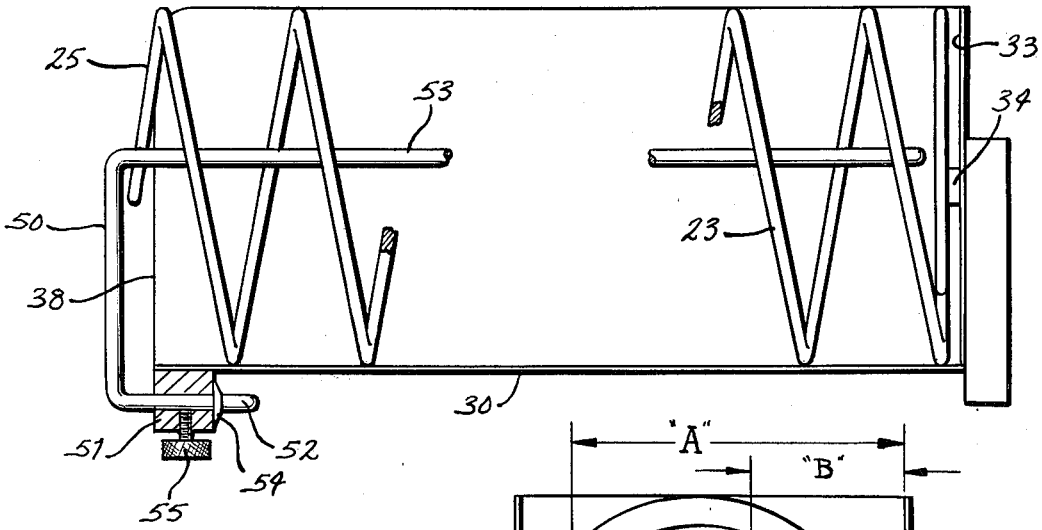
FIG. 3 is a vertical sectional view taken along line 3—3 of FIG. 2.

A plurality of packaged items 20 are positioned within each helix discharge unit 11 (FIG. 2). The discharge units 11 are designed so that they can be moved forward of the cabinet 12 for refilling. Each of the units 11 is similar and preferably comprises a tray assembly 21, a drive unit 22, a helix 23, and an adjustable rod mechanism 24.

In the form of the invention shown in FIGS. 1–4, the helix 23 is known as a rear driven helix which means that there is no positive connection between the drive means 22 and the leading edge 25 of the helix 23, and the only power applied to the helix 23 is at its connection to the drive means 22.

The tray assembly 21 comprises a bottom wall 30, which preferably has a layer of teflon or the like positioned along the upper side of the bottom wall 30 so that the helix 23 rotates thereon. This protects the surface of the bottom wall 30, which may be painted, and also acts as a friction and power consumption reducing element for the helix 23.

The tray assembly unit 12 further comprises side walls 32 and a rear wall 33. The drive unit 22 is attached to the back side of the rear wall 33 and has a drive shaft 34. A coupling means (not shown) is attached to the rearwardmost convolution of the helix 23 and terminates in a flattened surface which is positioned within the drive shaft 34, and engages a correspondingly flattened surface. Thus, when the drive unit 22 is energized, the drive shaft 34 rotates the coupling means and consequently the helix 23 is rotated to propel the packages 20 stored within the convolutions of the helix 23 toward the open end 38 of the tray assembly 21. The outermost package 20 is propelled out of the tray assembly 21 into the discharge chute 19. The unit is set up so that a package is discharged with each 360° rotation of the helix 23.

The adjustment means 24 is embodied in a U-shaped rod 50 which is pivotable in a support bracket 51. The rod 50 is mounted in the bracket 51 which is positioned beneath the tray bottom wall 30. As mentioned, the rod 50 is U-shaped at its forward end with the short leg 52 being mounted in the bracket 51. The long leg 53 extends rearwardly through the helix 23 and defines one side of the merchandise vending compartment. The other side of this compartment is defined by the inside of the tray wall.

The short leg 52 is retained in the bracket 51 by a pushnut 54 fitted over the free end of said leg 52. The rod 50 is held in any predetermined position by a set screw 55 threaded into the bottom of the bracket 51. The set screw 55 is screwed into engagement with the short leg 52 to hold the rod 50, including the elongated leg 53, in a fixed position to define the size of the merchandise vend compartment.

Figure 4:
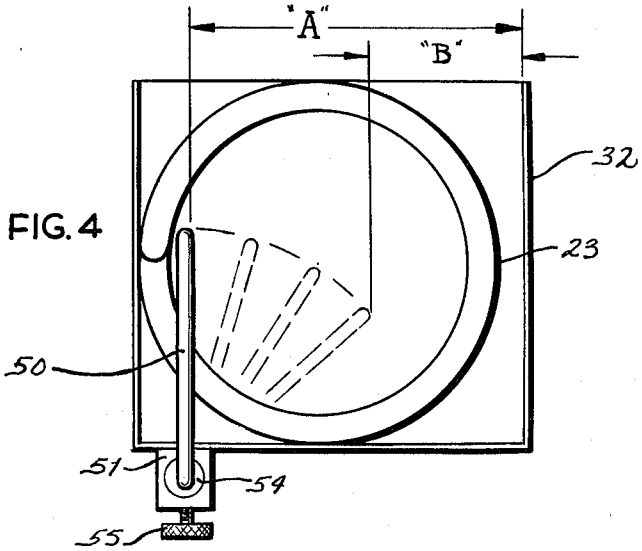
FIG. 4 is an end elevational view of a single dispensing module shown in FIG. 3.

When the rod 50 is vertical, the compartment is at its largest size denoted by the letter A in FIG. 4. When the rod 50 is pivoted toward the center of the helix 23, the compartment is smaller in size denoted by the letter B in FIG. 4. The only restriction on how far the rod 50 can be pivoted toward the center of the helix 23 is that it must be high enough from the tray bottom wall 30 to prevent merchandise packages from toppling over and becoming wedged in the helix 23.

What is claimed is:

1. A vending machine item discharge unit comprising:

(a) a tray means having a side wall, a second side wall, rear and bottom walls, (b) helical means positioned within the tray means having a plurality of convolutions along its length to retain articles to be dispensed in the convolutions, (c) drive means connected to the helical means to rotate said helical means in predetermined increments upon activation by a customer, and (d) pivotable rod means having a portion thereof positioned within the helical means toward one side of said tray and movable in the helix toward the second side of said tray to vary the size of the article compartment defined between the rod and the second side wall of said tray.

2. The unit of claim 1 wherein the helical means is connected to the drive means at the rear end of the helix.

3. The unit of claim 1 wherein the rod is a U-shaped member having a shorter leg positioned in a bracket mounted on the tray and a longer leg positioned in the helix.

4. The unit of claim 3 wherein the shorter leg of the rod is pivotable in the bracket and including means for locking said leg in a selected position to thereby cause the longer leg to define with the said second tray wall the size of the merchandise vend compartment.

5. The unit of claim 1 wherein the helix is formed of flattened wire.

* * * * *